US011402100B2

(12) United States Patent
Hu et al.

(10) Patent No.: US 11,402,100 B2
(45) Date of Patent: Aug. 2, 2022

(54) RING ASSEMBLY FOR DOUBLE-SKIN COMBUSTOR LINER

(71) Applicant: PRATT & WHITNEY CANADA CORP., Longueuil (CA)

(72) Inventors: Tin-Cheung John Hu, Markham (CA); Nassim Bedrani, Kanata (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 592 days.

(21) Appl. No.: 16/192,014

(22) Filed: Nov. 15, 2018

(65) Prior Publication Data

US 2020/0158344 A1 May 21, 2020

(51) Int. Cl.

| | |
|---|---|
| ***F23R 3/60*** | (2006.01) |
| ***F23R 3/50*** | (2006.01) |
| ***F23R 3/00*** | (2006.01) |
| *F23R 3/54* | (2006.01) |

(52) U.S. Cl.

CPC ..... *F23R 3/50* (2013.01); *F23R 3/007* (2013.01); *F23R 3/60* (2013.01); *F05D 2300/50212* (2013.01); *F23R 3/002* (2013.01); *F23R 3/54* (2013.01)

(58) Field of Classification Search

CPC .. F23R 3/007; F23R 3/002; F23R 3/50; F23R 3/60; F01D 25/26; F23M 2900/05002; F05D 2300/50212

See application file for complete search history.

(56) References Cited

U.S. PATENT DOCUMENTS

| | | | | |
|---|---|---|---|---|
| 4,614,082 | A * | 9/1986 | Sterman | F23R 3/002 60/800 |
| 4,901,522 | A * | 2/1990 | Commaret | F23R 3/08 60/800 |
| 5,012,645 | A * | 5/1991 | Reynolds | F23R 3/10 60/754 |
| 5,407,319 | A * | 4/1995 | Harrogate | F01D 11/005 415/115 |
| 6,269,628 | B1 * | 8/2001 | Gates | F01D 9/023 60/804 |
| 6,495,207 | B1 * | 12/2002 | Prociw | F23R 3/007 427/398.1 |
| 6,895,757 | B2 | 5/2005 | Mitchell et al. | |
| 6,895,761 | B2 | 5/2005 | Mitchell et al. | |

(Continued)

*Primary Examiner* — Todd E Manahan
*Assistant Examiner* — Marc J Amar
(74) *Attorney, Agent, or Firm* — Norton Rose Fulbright Canada LLP

(57) ABSTRACT

A ring assembly for holding a double-skin combustor liner has an inner skin of ceramic matrix composite and an outer skin. The assembly comprises an annular end body, a first projecting portion projecting relative to the annular end body at least partially in an axial direction, the first projecting portion configured for supporting the inner skin, a second projecting portion projecting relative to the annular end body at least partially in the axial direction, the second projecting portion configured for supporting the outer skin. The first and second projecting portions are radially spaced apart to provide a radial spacing between the inner skin and the outer skin. An expansion joint is between the ring assembly and the inner skin configured to permit motion resulting from a variation in thermal expansion between the inner skin and the ring assembly.

16 Claims, 3 Drawing Sheets

(56) References Cited

U.S. PATENT DOCUMENTS

| | | | | |
|---|---|---|---|---|
| 9,447,973 | B2 * | 9/2016 | Clemen | F23R 3/02 |
| 9,976,746 | B2 * | 5/2018 | Bloom | F02C 3/04 |
| 10,139,108 | B2 * | 11/2018 | Thackway | F23R 3/002 |
| 10,527,288 | B2 * | 1/2020 | Stastny | F23R 3/54 |
| 2013/0152591 | A1 * | 6/2013 | Dery | F23R 3/007 60/753 |
| 2015/0354820 | A1 * | 12/2015 | Vetters | F23R 3/44 29/888.01 |
| 2016/0215980 | A1 * | 7/2016 | Chang | F23R 3/50 |
| 2016/0215981 | A1 * | 7/2016 | Dery | F23R 3/002 |
| 2016/0258624 | A1 * | 9/2016 | Harding | F23M 5/04 |
| 2016/0313004 | A1 * | 10/2016 | Chang | F23R 3/002 |
| 2018/0017257 | A1 * | 1/2018 | Riehle | F23R 3/50 |
| 2019/0218924 | A1 * | 7/2019 | Mulcaire | F23R 3/002 |
| 2020/0124281 | A1 * | 4/2020 | Dillard | F23R 3/08 |
| 2020/0158341 | A1 * | 5/2020 | Bloom | F23R 3/60 |
| 2021/0102705 | A1 * | 4/2021 | Kramer | F23R 3/002 |
| 2021/0325043 | A1 * | 10/2021 | Freeman | F23R 3/46 |
| 2021/0332979 | A1 * | 10/2021 | Snyder | F23R 3/007 |

* cited by examiner

RING ASSEMBLY FOR DOUBLE-SKIN COMBUSTOR LINER

TECHNICAL FIELD

The application relates gas turbine engines and more particularly to double-skin combustor liners featuring ceramic matrix composite panels.

BACKGROUND

Ceramic Matrix Composites (CMC) parts are used in the hot side of a combustor for their capacity to sustain the temperatures of combustion. The CMC parts may be part of a double-skin liner, with an outer skin of metal acting as the structure supporting the CMC inner skin. With double-skin combustor construction, edges of the combustor can be sealed with the capping features for full annular or circumferentially segmented CMC combustor panels. One challenge with double-skin combustor challenge is the different thermal growth rates of the two skins, notably due to their exposure to different temperatures, and to the characteristics of their different materials.

SUMMARY

In one aspect, there is provided a ring assembly for holding a double-skin combustor liner having an inner skin of ceramic matrix composite and an outer skin, the assembly comprising an annular end body, a first projecting portion projecting relative to the annular end body at least partially in an axial direction, the first projecting portion configured for supporting the inner skin, a second projecting portion projecting relative to the annular end body at least partially in the axial direction, the second projecting portion configured for supporting the outer skin, the first and second projecting portions radially spaced apart to provide a radial spacing between the inner skin and the outer skin, and an expansion joint between the ring assembly and the inner skin configured to permit motion resulting from a variation in thermal expansion between the inner skin and the ring assembly.

In another aspect, there is provided a combustor for a gas turbine engine comprising: an inner liner and an outer liner concurrently defining at least one combustor chamber; a double-skin construction for at least part of the inner liner and/or the outer liner, the double-skin construction having an inner skin of ceramic matrix composite and an outer skin, with an annular space therebetween; a ring assembly comprising an annular end body, a first projecting portion projecting relative to the annular end body at least partially in an axial direction, the first projecting portion operatively connected to the inner skin, a second projecting portion projecting relative to the annular end body at least partially in the axial direction, the second projecting portion connected to the outer skin, a radial spacing between the first projecting portion and the second projecting portion to space the inner skin from the outer skin, an expansion joint formed between the ring assembly and the inner skin.

DESCRIPTION OF THE DRAWINGS

Reference is now made to the accompanying figures in which.

DETAILED DESCRIPTION

Figure 1:
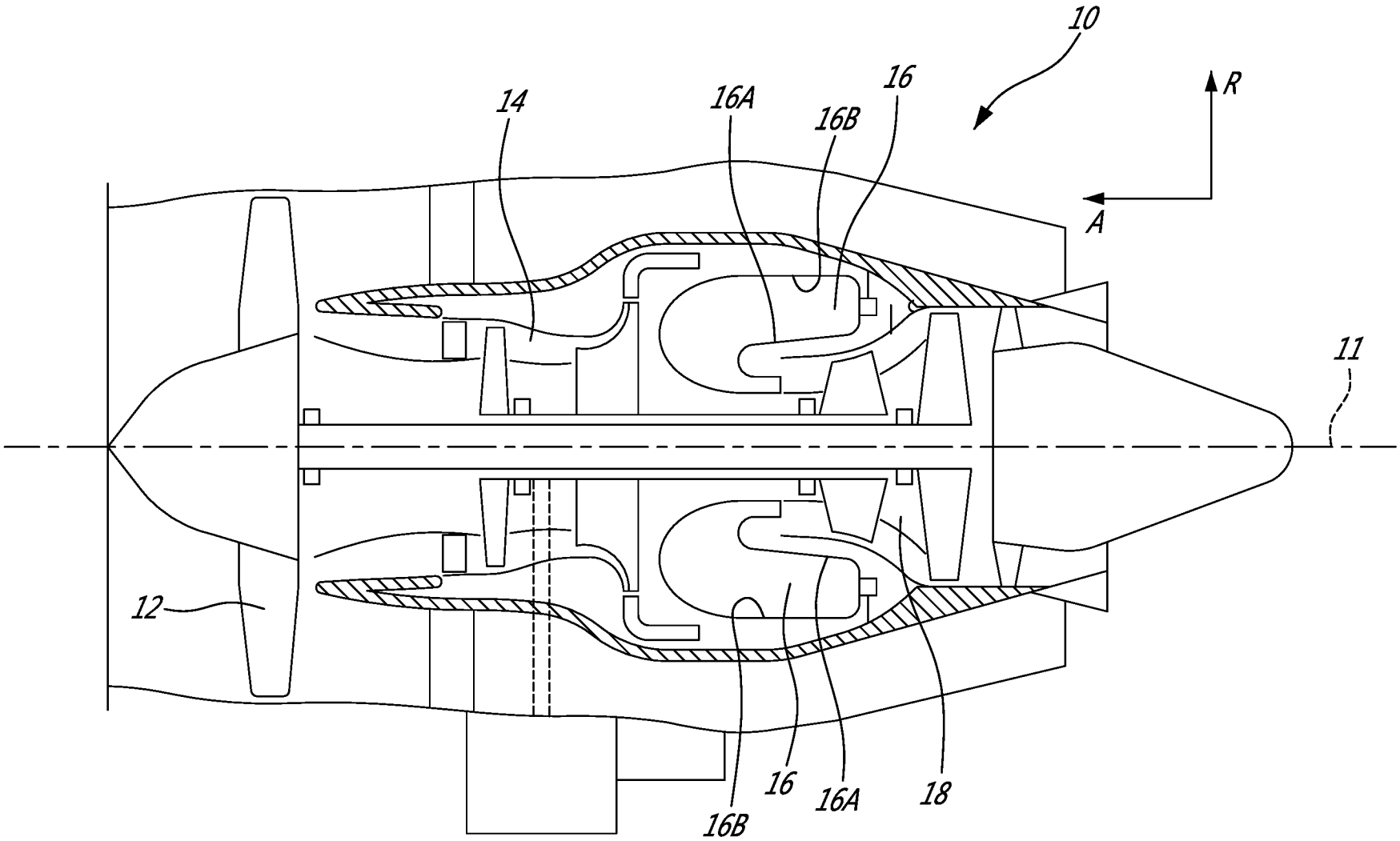
FIG. 1 is a schematic cross-sectional view of a gas turbine engine with a double-skin combustor in accordance with the present disclosure.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Components of the engine 10 are rotatable about a longitudinal center axis 11 of the engine 10.

The combustor 16 may have a double-skin construction as detailed hereinafter. The combustor 16 is annular in shape, around center axis 11. This explains the mirror images of the combustor 16 in FIG. 1, relative to the center axis 11. The combustor 16 may have an annular combustor chamber defined between an inner liner 16A and an outer liner 16B. Either one or both of the inner liner 16A and outer liner 16B may have double-skin constructions on part or all of the combustor 16. The combustor 16 may be reverse-flow, through-flow, the combustor 16 may be a can combustor 16 with double skin, etc.

Figure 2:
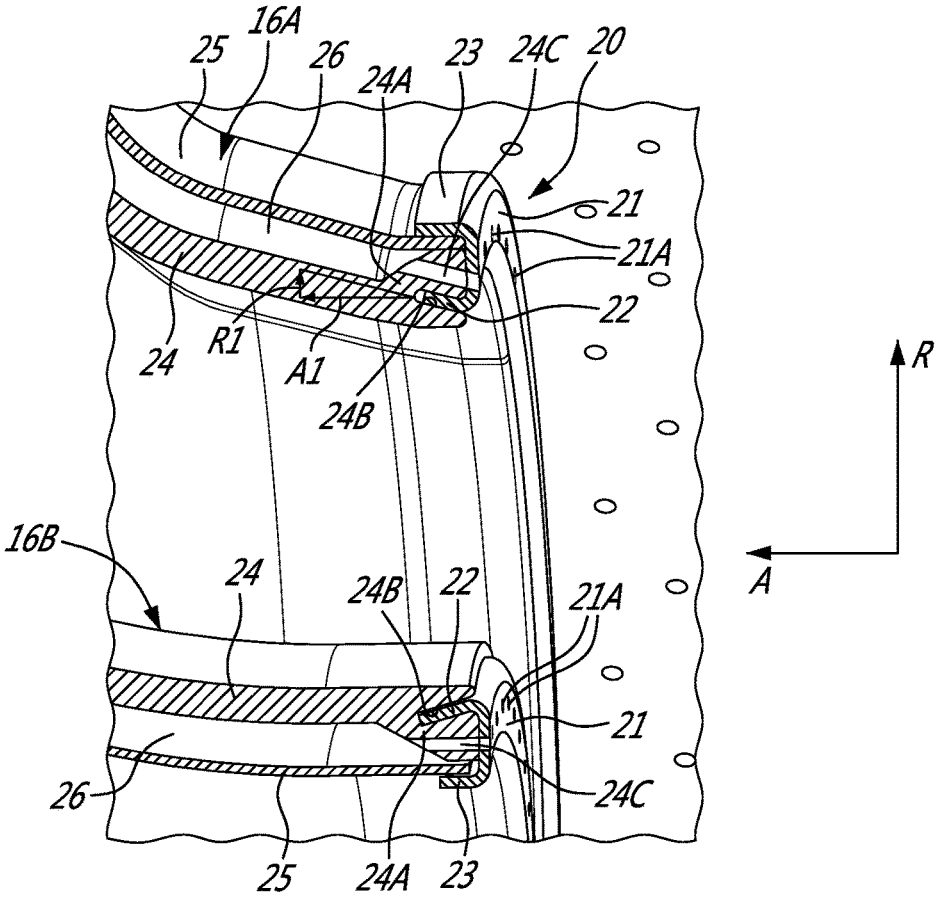
FIG. 2 is a sectional view of a ring assembly for a double-skin combustor in accordance with a first embodiment of the present disclosure.

Referring to FIG. 2, a ring assembly for holding a double-skin combustor liner is generally shown at 20. The ring assembly 20 may be used in the gas turbine engine 10 of FIG. 1, with one or both of the inner liner 16A and outer liner 16B. The ring assembly 20 may be tasked with holding the skins spaced apart from one another for effusion cooling, while allowing the thermal expansion of the skins relative to one another. The ring assembly 20 has an annular end body 21. The annular end body 21 may also be referred to as a ring, annulus, etc. The annular end body 21 may lie in a plane to which the center axis 11 is normal. However, other orientations are contemplated as well. The annular end body 21 may have a plurality of throughbores 21A circumferentially distributed along the annular end body 21. The throughbores 21A may participate in the cooling of the liners, by being in fluid communication with an annular space between the skins, so as to allow air movement.

An inner projecting portion 22 projects from the annular end body 21. The inner projecting portion 22 may be in the form of a ring portion extending along the full circumference of the annular end body 21. In another embodiment, the inner projecting portion 22 is formed of discrete annular segments circumferentially distributed along the circumference of the annular end body 21. The inner projecting portion 22 extends at least partially in an axial direction relatively to the gas turbine engine 10, i.e., in a direction aligned with the center axis 11. As observed, the inner projecting portion 22 may also extend at least partially in a radial direction. This may be illustrated relative to the coordinate system A,R, with A representative of an axial direction that is parallel to the center axis 11, and with R representative of a radial direction that is radial to the center axis 11. The inner projecting portion 22 may extend in a direction shown as having an axial component A1 and a radial component R1. Axial component A1 may be oriented toward an upstream direction of the combustor 16. Radial component R1 may be oriented radially away from the interior of the chamber of the combustor 16, though the contrary orientation is contemplated as well.

An outer projecting portion 23 may also project from the annular end body 21. The outer projecting portion 23 may also be in the form of a ring portion extending along the full circumference of the annular end body 21. In another embodiment, the outer projecting portion 23 is formed of discrete annular segments circumferentially distributed along the circumference of the annular end body 21. The outer projecting portion 23 extends at least partially, if not substantially in the axial direction A relatively to the gas turbine engine 10. The outer projecting portion 23 may or may not extend partially radially. The monikers "inner" and "outer" for the inner projecting portion 22 and for the outer projecting portion 23 are related to their respective position when supporting an inner skin and an outer skin as detailed hereinafter.

According to an embodiment, the annular end body 21, the inner projecting portion 22 and the outer projecting portion 23 are concurrently formed of a unitary annular metal body. For example, the unitary annular metal body may be cast, bent. The unitary annular metal body may be monoblock, or may result from the combination of different parts (e.g., welded together). Other configurations are possible. The ring assembly 20 may therefore have a U-shape section, with the opening of the U oriented toward an upstream direction of the combustor 16, so as to cooperate with the skins of the liners 16A and/or 16B. The inner projecting portion 22 and the outer projecting portion 23 have a radial spacing between them, which radial spacing will be used to space the skins apart. The radial spacing may be variable: the inner projecting portion 22 may converge toward the outer projecting portion 23, due to the radial component R1 of the orientation of the inner projecting portion 22. The outer projecting portion 23 may be generally square to the annular end body 21, although other orientations are contemplated. In an embodiment, the ring assembly 20 may be described as a metal clip, due to the U-shape cross section. The U-shape cross section may extend for all 360 degrees of the annular end body 21.

The ring assembly 20 is configured to hold an inner skin 24 and an outer skin 25 spaced apart from one another, such that an annular space 26 is defined between the skins 24 and 25. The skins 24 and 25 may be part of the inner liner 16A or of the outer liner 16B. The inner skin 24 is the one that delimits an interior of the combustor 16. The inner skin 24 may be known as being the hot-side panel and is thus exposed to the combustion gases and temperatures. The inner skin 24 is made of a ceramic matrix composite (CMC) or high temperature metal alloy. However, for simplicity reference is made herein to CMC inner skins. The CMC used in one in which fibers (e.g., ceramic fibers, silicon carbide, alumina, carbon, carbon fibers, etc) are embedded in a ceramic matrix. For example, the inner skin 24 may be made of tiles of CMC panels. As another possibility, the inner skin 24 is made of a single annular body of CMC, i.e. over 360 degrees. The ring assembly 20 may be used with both configurations of the inner skin 24.

The inner skin 24 is shown as having an enlarged portion 24A at its end edge. The end edge of the inner skin 24 may be circular and may be generally concentric relative to the center axis 11 when installed in the engine 10. An annular slot 24B may be formed into the enlarged portion 24A. The annular slot 24B may have a depth extending both axially and radially, in similar fashion to the direction of the inner projecting portion 22. The inner projecting portion 22 will be received in the annular slot 24B, such that the inner projecting portion 22 and the annular slot 24B concurrently form an expansion joint, by which the inner skin 24 may move relative to the inner projecting portion 22. Throughbores 24C may also be defined into the enlarged portion 24A, for cooling purposes. As shown in FIG. 2, the throughbores 24C may be aligned with the throughbores 21A of the annular end body 21.

The outer skin 25 defines an exterior of the combustor 16. The outer skin 25 may be known as the shell or metal shell of the combustor 16. The outer skin 25 forms the structure of the combustor 16, in that it will supporting the inner skin 24. The outer skin 25 is made of metal, such as interconnected metallic segments or a single annular metallic body. Although not shown, connectors, beams, or like structural components may be provided on the outer skin 25 for its connection to a structure of the gas turbine engine 10.

As assembled, the ring assembly 20 holds the inner skin 24 and the outer skin 25 spaced apart from one another with the annular space 26 between them. The inner skin 24 being of CMC, and the outer skin 25 being of metal, the thermal expansion may differ between the inner skin 24 and the outer skin 25 during combustion. This thermal expansion differential may have an axial component and/or a radial component to it. Stated differently, the inner skin 24 may expand in the axial direction differently than the outer skin 25 and/or the inner skin 24 may expand in the radial direction differently than the outer skin 25. Accordingly, the presence of the expansion joint formed by the ring assembly 20 supporting the skins 24 and 25, allows such expansion differential while not substantially stressing the skins 24 and 25. As the inner projecting portion 22 may extend both in the axial direction A and the radial direction R, as per A1 and R1, the expansion joint may allow some floating axially and radially.

The radial spacing between the inner projecting portion 22 and the outer projecting portion 23 is such that the annular space 26 is preserved. Though not shown, some cooling holes may be defined in one or both of the skins 24 and 25, for cooling purposes. In an embodiment, the outer projecting portion 23 of the ring assembly 20 is fixedly attached to the outer skin 25, such as with connectors, welding, etc. Because of the sizing of the ring assembly 20, little play may remain in the cavity of the U-shape section for the enlarged portion 24A to be held captive between the inner projecting portion 22 and the outer skin 25. There may remain sufficient play to allow the radial and/or axial movements enabled by the expansion joint, as a result of the relative expansions and contractions of the skins 24 and 25 relative to one another. Consequently, it may be said that the expansion joint is a radial expansion joint and an axial expansion joint. In the arrangement of the ring assembly 20, the metallic components are isolated from the combustion gases. For example, the inner projecting portion 22 is concealed into the annular slot 24B of the inner skin 24, so as not to be exposed directly to the exhaust gases of the combustor 16.

Figure 3:
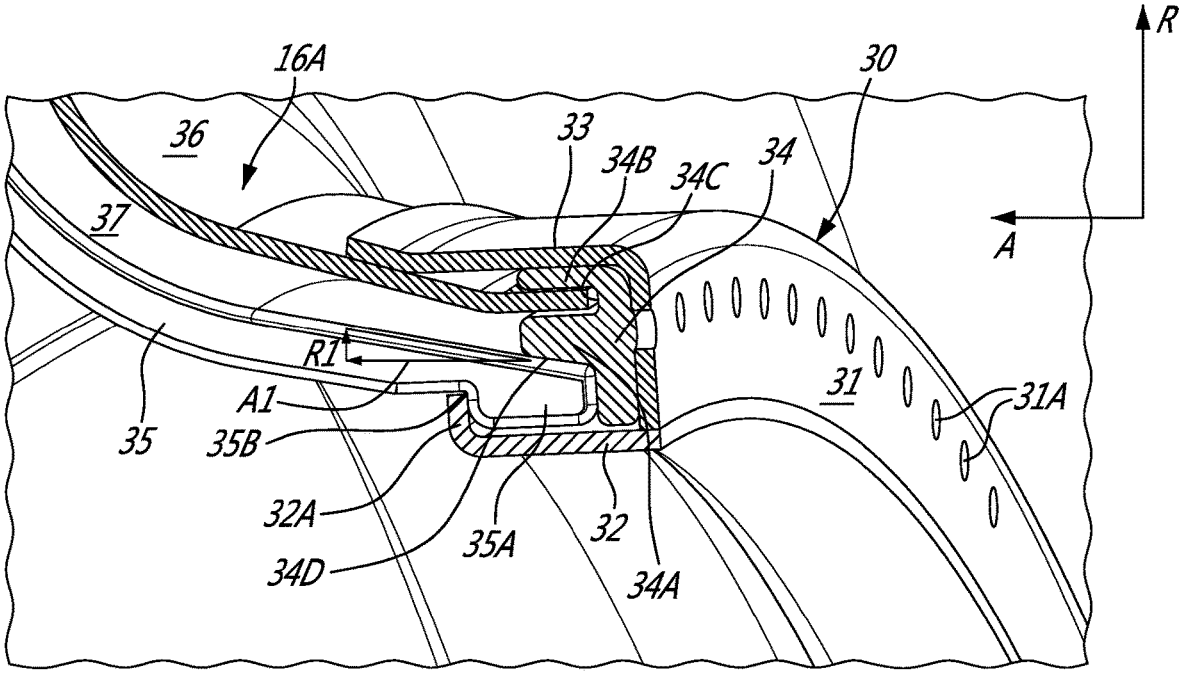
FIG. 3 is a sectional view of a ring assembly for a double-skin combustor in accordance with a second embodiment of the present disclosure.

Referring to FIG. 3, another embodiment of ring assembly for holding a double-skin combustor liner is generally shown at 30. The ring assembly 30 may be used in the gas turbine engine 10 of FIG. 1, with one or both of the inner liner 16A and outer liner 16B, though shown as being on the inner liner 16A in FIG. 3. The ring assembly 30 may be tasked with holding the skins spaced apart from one another for effusion cooling, while allowing the thermal expansion of the skins relative to one another.

The ring assembly 30 has an annular end body that may be constituted of a metal ring 31, with an inner projecting portion 32 and an outer projecting portion 33, and of one or more end member 34. The metal ring 31 may lie in a plane to which the center axis 11 is normal. However, other orientations are contemplated as well. The metal ring 31 may have a plurality of throughbores 31A circumferentially distributed along the metal ring 31. The throughbores 31A may participate in the cooling of the liners, by being in fluid communication with an annular space between the skins, so as to allow air movement.

The inner projecting portion 32 projects from the metal ring 31. The inner projecting portion 32 may be in the form of a ring portion extending along the full circumference of the metal ring 31. In another embodiment, the inner projecting portion 32 is formed of discrete annular segments circumferentially distributed along the circumference of the metal ring 31. The inner projecting portion 32 extends at least partially in an axial direction relatively to the gas turbine engine 10, i.e., in a direction aligned with the center axis 11, though it may also have a radial component. A lip 32A may be defined at the free end of the inner projecting portion 32.

An outer projecting portion 33 may also project from the metal ring 31. The outer projecting portion 33 may also be in the form of a ring portion extending along the full circumference of the metal ring 31. In another embodiment, the outer projecting portion 33 is formed of discrete annular segments circumferentially distributed along the circumference of the metal ring 31. The outer projecting portion 33 extends at least partially, if not substantially in the axial direction A relatively to the gas turbine engine 10. The outer projecting portion 33 may or may not extend partially radially.

According to an embodiment, the metal ring 31, the inner projecting portion 32 and the outer projecting portion 33 are concurrently formed of a unitary annular metal body. For example, the unitary annular metal body may be cast, bent, with the inner projecting portion 32 joined during installation of the ring assembly 30. The joining may be by welding and/or by using connectors/fasteners. Other configurations are possible. The metal ring 31, with the inner projecting portion 32 and the outer projecting portion 33, may therefore have a concave section, with the opening of the concave section open toward an upstream direction of the combustor 16, so as to cooperate with the skins of the liners 16A and/or 16B. The inner projecting portion 32 and the outer projecting portion 33 have a radial spacing between them, which radial spacing will be used to receive the end member(s) 34 to space the skins apart.

The end member 34 may be a single annular ring, or a plurality of discrete annular segments spaced apart. In an embodiment, the end member(s) 34 may be made of CMC or of ceramic. Other materials may be used, such as metals. The end member(s) 34 may have a projecting portion 34A and a projecting portion 34B, concurrently defining an annular slot 34C, for receiving an outer skin. The annular slot 34C may have any appropriate orientation. For example, the annular slot 34C may be oriented substantially in the axial direction. The projecting portion 34A may also define a sliding surface 34D. As observed, the sliding surface 34D may extend at least partially in the axial direction and the radial direction, relative to the coordinate system A,R, with A representative of an axial direction that is parallel to the center axis 11, and with R representative of a radial direction that is radial to the center axis 11. The sliding surface 34D may extend in a direction shown as having axial component A1 and radial component R1. Axial component A1 may be oriented toward an upstream direction of the combustor 16. Radial component R1 may be oriented radially away from the interior of the chamber of the combustor 16, though the contrary orientation is contemplated as well.

The ring assembly 30 is configured to hold an inner skin 35 and an outer skin 36 spaced apart from one another, such that an annular space 37 is defined between the skins 35 and 36. The skins 35 and 36 may be part of the inner liner 16A or of the outer liner 16B. In similar fashion to FIG. 2, and consistently with FIGS. 4 and 5, the inner skin is the one that delimits an interior of the combustor 16. The inner skin may be known as being the hot-side panel and is thus exposed to the combustion gases and temperatures. The inner skin is made of CMC.

The inner skin 35 is shown as having an enlarged portion 35A at its end edge. The end edge of the inner skin 35 may be circular and may be generally concentric relative to the center axis 11 when installed in the engine 10. An annular groove 35B may delimit the enlarged portion 35A. The inner projecting portion 32 and the end member(s) 34 concurrently define a cavity that will receive the enlarged portion 35A. When received between the cavity of the inner projecting portion 32 and end member(s) 34, the inner skin 35 is in sliding contact with the sliding surface 34D of the end member(s) 34, such that the sliding surface 34D and the enlarged portion 35A concurrently form an expansion joint, by which the inner skin 35 may move relative to the ring assembly 30, axially and/or radially. The lip 32A of the inner projecting portion 32 and the annular groove 35B may collaborate for the inner skin 35 to be held captive in the cavity of the inner projecting portion 32 and end member(s) 34. However, some play is provided to allow the axial and/or radial movement of the inner skin 35 relative to the ring assembly 30.

As assembled, the ring assembly 30 holds the inner skin 35 and the outer skin 36 spaced apart from one another with the annular space 37 between them. In similar fashion to FIG. 2, and consistently with FIGS. 4 and 5, the inner skin 35 being of CMC, and the outer skin 36 being of metal, the thermal expansion may differ between the inner skin 35 and the outer skin 36 during combustion. This thermal expansion differential may have an axial component and/or a radial component to it. Stated differently, the inner skin 35 may expand in the axial direction differently than the outer skin 36 and/or the inner skin 35 may expand in the radial direction differently than the outer skin 36. Accordingly, the presence of the expansion joint formed by the ring assembly 30 supporting the skins 35 and 36, allows such expansion differential while not substantially stressing the skins 35 and 36. As the sliding surface 34D may extend both in the axial direction A and the radial direction R, as per A1 and R1, the expansion joint may allow some floating axially and radially. Consequently, it may be said that the expansion joint is a radial expansion joint and an axial expansion joint.

The radial spacing between the projecting portions 32, 33, 34A and 34B is such that the annular space 37 is preserved, for backside cooling of the inner skin 35. Though not shown, some cooling holes may be defined in one or both of the skins 35 and 36, for cooling purposes. In an embodiment, the outer projecting portion 33 of the ring assembly 30 is fixedly attached to the outer skin 36, such as with connectors, welding, etc. The outer projecting portion 33 may diverge radially so as to conform to the shape of the outer skin 36.

Figure 4:
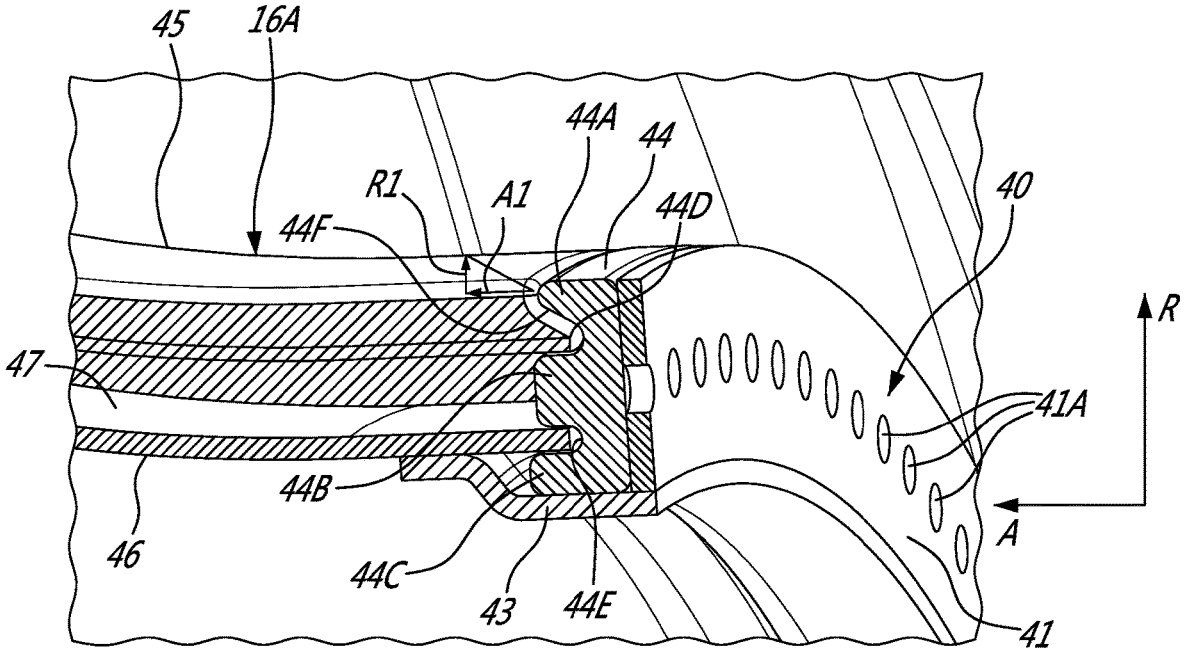
FIG. 4 is a sectional view of a ring assembly for a double-skin combustor in accordance with a third embodiment of the present disclosure.

Referring to FIG. 4, another embodiment of ring assembly for holding a double-skin combustor liner is generally shown at 40. The ring assembly 40 may be used in the gas turbine engine 10 of FIG. 1, with one or both of the inner liner 16A and outer liner 16B, though shown as being on the inner liner 16A in FIG. 4. The ring assembly 40 may be tasked with holding the skins spaced apart from one another for effusion cooling, while allowing the thermal expansion of the skins relative to one another.

The ring assembly 40 has an annular end body that may be constituted of a metal ring 41, with an outer projecting portion 43, and of an annular end member 44. The metal ring 41 may lie in a plane to which the center axis 11 is normal. However, other orientations are contemplated as well. The metal ring 41 may have a plurality of throughbores 41A circumferentially distributed along the metal ring 41. The throughbores 41A may participate in the cooling of the liners, by being in fluid communication with an annular space between the skins, so as to allow air movement.

The outer projecting portion 43 may project from the metal ring 41. The outer projecting portion 43 may also be in the form of a ring portion extending along the full circumference of the metal ring 41. In another embodiment, the outer projecting portion 43 is formed of discrete annular segments circumferentially distributed along the circumference of the metal ring 41. The outer projecting portion 43 extends at least partially, if not substantially in the axial direction A relatively to the gas turbine engine 10. The outer projecting portion 43 may or may not extend partially radially.

According to an embodiment, the metal ring 41 and the outer projecting portion 43 are concurrently formed of a unitary annular metal body. For example, the unitary annular metal body may be cast, bent, with the outer projecting portion 43 joined during installation of the ring assembly 40. The joining may be by welding and/or by using connectors/fasteners. Other configurations are possible. The metal ring 41, with the outer projecting portion 43, may therefore have a concave section.

The end member 44 may be a single annular ring. In an embodiment, the end member 44 may be made of CMC or of ceramic. The end member(s) 44 may have projecting portions 44A, 44B and 44C, concurrently defining annular slots 44D and 44E, for receiving an inner skin and an outer skin. The annular slots 44D and 44E may have any appropriate orientation. For example, the annular slots 44D and 44E may be oriented substantially in the axial direction. The projecting portion 44A may also define a sliding surface 44F that is part of the annular slot 44D. As observed, the sliding surface 44F may extend at least partially in the axial direction and the radial direction, relative to the coordinate system A,R, with A representative of an axial direction that is parallel to the center axis 11, and with R representative of a radial direction that is radial to the center axis 11. The sliding surface 44F may extend in a direction shown as having axial component A1 and radial component R1. Axial component A1 may be oriented toward an upstream direction of the combustor 16. Radial component R1 may be oriented radially away from the interior of the chamber of the combustor 16, though the contrary orientation is contemplated as well.

The ring assembly 40 is configured to hold an inner skin 45 and an outer skin 46 spaced apart from one another, such that an annular space 47 is defined between the skins 45 and 46. The skins 45 and 46 may be part of the inner liner 16A or of the outer liner 16B. The inner skin 45 is made of CMC as it is on the hot side of the combustor 16.

The inner skin 45 is shown as having a sliding surface 45A at its end edge. The end edge of the inner skin 45 may be circular and may be generally concentric relative to the center axis 11 when installed in the engine 10. The end edge of the inner skin 45 is received in the annular slot 44E. When received in the annular slot 44E, the sliding surface 45A of the inner skin 45 is in sliding contact with the sliding surface 44F of the end member 44, such that the sliding surfaces 44F and 45A concurrently form an expansion joint, by which the inner skin 45 may move relative to the ring assembly 40, axially and/or radially. The sliding surfaces 44F and 45A form a sealing arrangement. In an embodiment in which the end member 44 is made of a CMC and the inner liner is CMC, then there will be a CMC-CMC sealing contact.

As assembled, the ring assembly 40 holds the inner skin 45 and the outer skin 46 spaced apart from one another with the annular space 47 between them. In similar fashion to FIGS. 2 and 3, the inner skin 45 being of CMC, and the outer skin 46 being of metal, the thermal expansion may differ between the inner skin 45 and the outer skin 46 during combustion. This thermal expansion differential may have an axial component and/or a radial component to it. Stated differently, the inner skin 45 may expand in the axial direction differently than the outer skin 46 and/or the inner skin 45 may expand in the radial direction differently than the outer skin 46. The presence of the expansion joint formed by the ring assembly 40 supporting the skins 45 and 46, allows such expansion differential while not substantially stressing the skins 45 and 46. As the sliding surface 44F may extend both in the axial direction A and the radial direction R, as per A1 and R1, the expansion joint may allow some floating axially and radially. Consequently, it may be said that the expansion joint is a radial expansion joint and an axial expansion joint.

The radial spacing between the projecting portions annular slots 44D and 44E is such that the annular space 47 is preserved, for backside cooling of the inner skin 45. Though not shown, some cooling holes may be defined in one or both of the skins 45 and 46, for cooling purposes. In an embodiment, the outer projecting portion 43 of the ring assembly 40 is fixedly attached to the outer skin 46, such as with connectors, welding, etc. The end edge of the outer skin 46 is then received in the annular slot 44E of the annular end member 44. As a consequence, when assembled in the manner shown in FIG. 4, the end member 44 is held captive between the metal ring 41, its outer projecting portion 43 and the outer skin 46. In the arrangement of the ring assembly 40, the metallic components are substantially isolated from the combustion gases.

Figure 5:
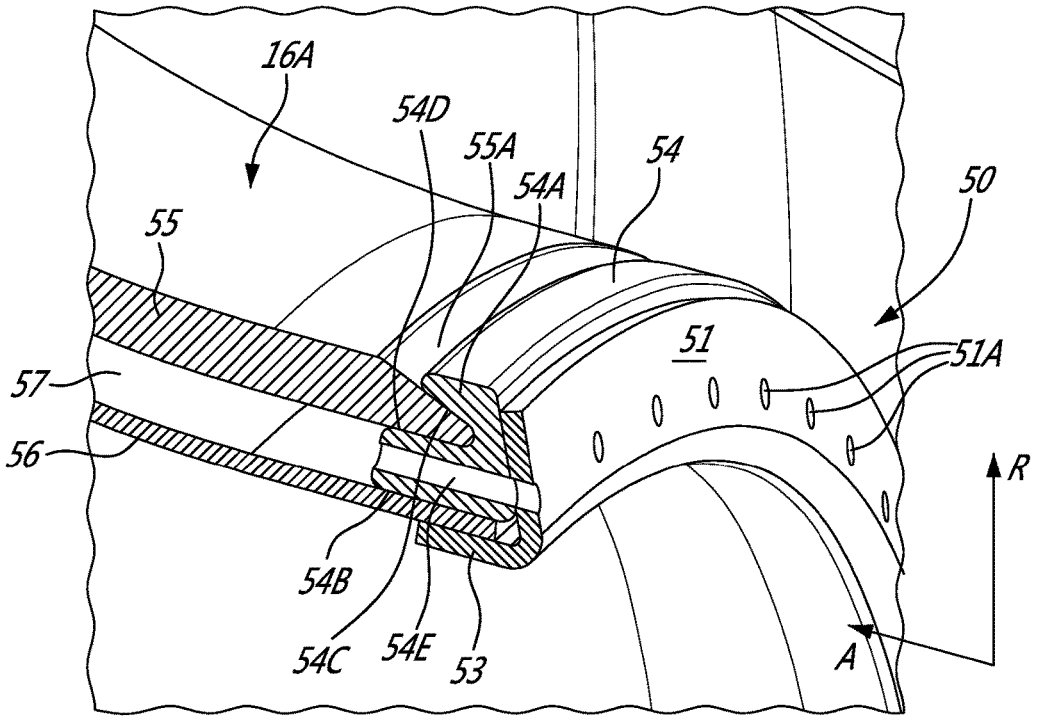
FIG. 5 is a sectional view of a ring assembly for a double-skin combustor in accordance with a fourth embodiment of the present disclosure.

Referring to FIG. 5, another embodiment of ring assembly for holding a double-skin combustor liner is generally shown at 50. The ring assembly 50 may be used in the gas turbine engine 10 of FIG. 1, with one or both of the inner liner 16A and outer liner 16B, though shown as being on the inner liner 16A in FIG. 5. The ring assembly 50 may be tasked with holding the skins spaced apart from one another for effusion cooling, while allowing the thermal expansion of the skins relative to one another.

The ring assembly 50 has an annular end body that may be constituted of a metal ring 51, with an outer projecting portion 53, and of an annular end member 54. The metal ring 51 may generally be frustoconical with a center thereof being aligned with the center axis 11 of the gas turbine engine 10 when installed therein. However, other orientations are contemplated as well. The metal ring 51 may have a plurality of throughbores 51A circumferentially distributed along the metal ring 51. The throughbores 51A may participate in the cooling of the liners, by being in fluid communication with an annular space between the skins, so as to allow air movement.

The outer projecting portion 53 may project from the metal ring 51. The outer projecting portion 53 may also be in the form of a ring portion extending along the full circumference of the metal ring 51. In another embodiment, the outer projecting portion 53 is formed of discrete annular segments circumferentially distributed along the circumference of the metal ring 51. The outer projecting portion 53 extends at least partially, if not substantially in the axial direction A relatively to the gas turbine engine 10. The outer projecting portion 53 may or may not extend partially radially.

According to an embodiment, the metal ring 51 and the outer projecting portion 53 are concurrently formed of a unitary annular metal body. For example, the unitary annular metal body may be cast, bent. Though shown as monoblock in FIG. 5, with the outer projecting portion 53 may be joined during installation of the ring assembly 50. The joining may be by welding and/or by using connectors/fasteners. Other configurations are possible. The metal ring 51, with the outer projecting portion 53, may therefore have a concave section, with a L-shape section, or a chevron-shape section.

The end member 54 may be a single annular ring. In an embodiment, the end member 54 may be made of CMC or of ceramic. The end member(s) 54 may have projecting portions 54A and 54B, concurrently defining annular slot 54C, for receiving an inner skin. The annular slot 54C may have any appropriate orientation. For example, the annular slot 54C may be oriented substantially in the axial direction. The projecting portion 54A may also define a sliding surface 54D that is part of the annular slot 54C. As observed, the sliding surface 54D may extend at least partially in the axial direction and the radial direction, relative to the coordinate system A,R, with A representative of an axial direction that is parallel to the center axis 11, and with R representative of a radial direction that is radial to the center axis 11. The sliding surface 54D may extend in a direction shown as having axial component A1 and radial component R1. Axial component A1 may be oriented toward an upstream direction of the combustor 16. Radial component R1 may be oriented radially away from the interior of the chamber of the combustor 16, though the contrary orientation is contemplated as well. Throughbores 54E may be provided in the end member 54, for cooling. The throughbores 54E may be axially oriented (or at least partially), and be in register with the throughbores 51A.

The ring assembly 50 is configured to hold an inner skin 55 and an outer skin 56 spaced apart from one another, such that an annular space 57 is defined between the skins 55 and 56. The skins 55 and 56 may be part of the inner liner 16A or of the outer liner 16B. The inner skin 55 is made of CMC as it is on the hot side of the combustor 16.

The inner skin 55 is shown as having a sliding surface 55A at its end edge. The end edge of the inner skin 55 may be circular and may be generally concentric relative to the center axis 11 when installed in the engine 10. The end edge of the inner skin 55 is received in the annular slot 54C. When received in the annular slot 54C, the sliding surface 55A of the inner skin 55 is in sliding contact with the sliding surface 54D of the end member 54, such that the sliding surfaces 54D and 55A concurrently form an expansion joint, by which the inner skin 55 may move relative to the ring assembly 50, axially and/or radially. The sliding surfaces 54D and 55A form a sealing arrangement. In an embodiment in which the end member 54 is made of a CMC and the inner liner is CMC, then there will be a CMC-CMC sealing contact.

As assembled, the ring assembly 50 holds the inner skin 55 and the outer skin 56 spaced apart from one another with the annular space 57 between them. In similar fashion to FIGS. 2, 3 and 4, the inner skin 55 being of CMC, and the outer skin 56 being of metal, the thermal expansion may differ between the inner skin 55 and the outer skin 56 during combustion. This thermal expansion differential may have an axial component and/or a radial component to it. Stated differently, the inner skin 55 may expand in the axial direction differently than the outer skin 56 and/or the inner skin 55 may expand in the radial direction differently than the outer skin 56. The presence of the expansion joint formed by the ring assembly 40 supporting the skins 55 and 56, allows such expansion differential while not substantially stressing the skins 55 and 56. As the sliding surface 54D may extend both in the axial direction A and the radial direction R, as per A1 and R1, the expansion joint may allow some floating axially and radially. Consequently, it may be said that the expansion joint is a radial expansion joint and an axial expansion joint.

In an embodiment, the outer projecting portion 53 of the ring assembly 50 is fixedly attached to the outer skin 56, such as with connectors, welding, etc. The end edge of the outer skin 56 is therefore received in an annular space formed between the outer projecting portion 53 and of the annular end member 54. Because of the frusto conical shape of the metal ring 51, when assembled in the manner shown in FIG. 5, the end member 54 is held captive between the metal ring 51 and the outer skin 53. In the arrangement of the ring assembly 50, the metallic components are substantially isolated from the combustion gases.

In the ring assemblies 20, 30, 40 and 50 described above, the trailing edge (a.k.a., downstream end) of each combustor 16 is ended with an end cap feature that provides spacing between the hot-side CMC panels of the inner skins and the cold side metallic outer shell forming the outer skin. The outer metallic shell, i.e., the outer skin, provides the retention to hold the ring assemblies 20, 30, 40 and 50 in place. Backside impingement cooling flow may exit the double-skin structure through effusion holes on the CMC inner skin, as well as through the throughbores at the end cap feature. There is a play for radial and axial growth between the CMC panel(s) of the inner skin and the end cap. This end cap can be annular or in segments with angled overlapping edges.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A ring assembly for holding a double-skin combustor liner having an inner skin of ceramic matrix composite and a metal outer skin, the ring assembly comprising an annular end body, a first projecting portion projecting relative to the annular end body at least partially in an axial direction, the first projecting portion configured for supporting the inner skin of ceramic matrix composite, a second projecting portion projecting relative to the annular end body at least partially in the axial direction, the second projecting portion configured for supporting the metal outer skin, the first and second projecting portions radially spaced apart to provide a radial spacing between the inner skin of ceramic matrix composite and the metal outer skin, and an expansion joint between the metal outer skin and the inner skin of ceramic matrix composite configured to permit motion resulting from a variation in thermal expansion between the inner skin of ceramic matrix composite and the metal outer skin, and wherein the annular end body is a metal ring, the ring assembly including at least one end member of ceramic matrix composite and wherein the inner skin of ceramic matrix composite is supported by the first projecting portion and a projecting portion of the at least one end member of ceramic matrix composite.

2. The ring assembly according to claim 1, wherein the annular end body, the first projecting portion and the second projecting portion are concurrently formed of a unitary annular metal body.

3. The ring assembly according to claim 2, wherein the unitary annular metal body has a U-shape section, the first projecting portion projecting relative to the annular end body in at least partially a radial outward direction.

4. The ring assembly according to claim 1, wherein the at least one end member of ceramic matrix composite is an annular end member supported by the metal ring.

5. The ring assembly according to claim 1, wherein the second projecting portion at least partially surrounds an outer slot adapted to receive an end of the metal outer skin.

6. The ring assembly according to claim 5, wherein the outer slot is concurrently defined by the at least one end member of ceramic matrix composite and the second projection portion.

7. The ring assembly according to claim 5, wherein the outer slot is solely defined by the at least one end member of ceramic matrix composite.

8. The ring assembly according to claim 1, wherein the annular end body, the first projecting portion and the second projecting portion are concurrently formed of a unitary annular metal body and wherein the unitary annular metal body has a U-shape section, the at least one end member of ceramic matrix composite received in a cavity of the unitary annular metal body.

9. The ring assembly according to claim 1, comprising holes in the annular end body adapted to be in fluid communication with an annular space between the inner skin of ceramic matrix composite and the metal outer skin.

10. The ring assembly according to claim 1, wherein the inner skin of ceramic matrix composite includes the at least one end member of ceramic matrix composite.

11. A combustor for a gas turbine engine comprising:

an inner liner and an outer liner concurrently defining at least one combustor chamber;

a double-skin construction for at least part of one or both of the inner liner and the outer liner, the double-skin construction having an inner skin of ceramic matrix composite and a metal outer skin, with an annular space therebetween;

a ring assembly comprising an annular end body, a first projecting portion projecting relative to the annular end body at least partially in an axial direction, the first projecting portion operatively connected to the inner skin of ceramic matrix composite, a second projecting portion projecting relative to the annular end body at least partially in the axial direction, the second projecting portion connected to the metal outer skin, a radial spacing between the first projecting portion and the second projecting portion to space the inner skin of ceramic matrix composite from the metal outer skin, an expansion joint formed between the metal outer skin and the inner skin of ceramic matrix composite; and wherein the annular end body is a metal ring, the combustor including at least one end member of ceramic matrix composite and wherein the inner skin of ceramic matrix composite is supported between the first projecting portion and the at least one end member of ceramic matrix composite, the at least one end member of ceramic matrix composite forming a sliding surface.

12. The combustor according to claim 11, wherein the annular end body, the first projecting portion and the second projecting portion are concurrently formed of a unitary annular metal body.

13. The combustor according to claim 11, wherein the at least one end member of ceramic matrix composite is an annular end member supported by the metal ring.

14. The combustor according to claim 11, wherein the second projecting portion at least partially surrounds an outer slot adapted to receive an end of the outer skin.

15. The combustor according to claim 11, wherein the outer slot is concurrently by the at least one end member of ceramic matrix composite and the second projection portion.

16. The combustor according to claim 14, wherein the outer slot is solely defined by the at least one end member of ceramic matrix composite.

* * * * *